US010968033B2

(12) United States Patent
Petit et al.

(10) Patent No.: US 10,968,033 B2
(45) Date of Patent: Apr. 6, 2021

(54) METERING VALVE AND FLUID PRODUCT DISPENSING DEVICE COMPRISING SUCH A VALVE

(71) Applicant: APTAR FRANCE SAS, Le Neubourg (FR)

(72) Inventors: Ludovic Petit, Vitot (FR); Ségolène Sarrailh, Heudebouville (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 16/610,749

(22) PCT Filed: May 4, 2018

(86) PCT No.: PCT/FR2018/051119
§ 371 (c)(1),
(2) Date: Nov. 4, 2019

(87) PCT Pub. No.: WO2018/203013
PCT Pub. Date: Nov. 8, 2018

(65) Prior Publication Data

US 2020/0071062 A1 Mar. 5, 2020

(30) Foreign Application Priority Data

May 5, 2017 (FR) ..... 17 54009

(51) Int. Cl.
*B65D 83/54* (2006.01)
*B05B 12/02* (2006.01)

(52) U.S. Cl.
CPC ..... *B65D 83/54* (2013.01); *B05B 12/02* (2013.01)

(58) Field of Classification Search
CPC .. B05B 12/02; B65D 83/54–546; B65D 83/48
See application file for complete search history.

(56) References Cited

U.S. PATENT DOCUMENTS 3,547,317 A * 12/1970 Green ..... B65D 83/425 222/402.2
3,738,542 A * 6/1973 Ruscitti ..... B65D 83/54 222/402.16

(Continued)

FOREIGN PATENT DOCUMENTS

WO 2014/199182 A1 12/2014

OTHER PUBLICATIONS

International Search Report for PCT/FR2018/051119 dated Sep. 14, 2018 [PCT/ISA/210].

(Continued)

*Primary Examiner* — Frederick C Nicolas
*Assistant Examiner* — Randall A Gruby
(74) *Attorney, Agent, or Firm* — Sughrue Mion, PLLC

(57) ABSTRACT

A metering valve for dispensing fluid, having a valve body containing a metering chamber, and a valve member slidable axially in the valve body between rest position and dispensing positions, the valve member urged towards its rest position by a spring. The valve member including a central axial channel provided with an axial outlet orifice and with a radial inlet channel arranged in the metering chamber when the valve member is in its dispensing position. The radial inlet channel including an inlet opening and an outlet opening that opens out into the central axial channel, the diameter of the radial inlet channel in the range 0.30 mm to 0.40 mm. The diameter of the outlet opening is equal to the diameter of the radial inlet channel, and the diameter of the inlet opening is greater than the diameter of the radial inlet channel.

7 Claims, 3 Drawing Sheets

(56) References Cited

U.S. PATENT DOCUMENTS 4,322,037 A * 3/1982 Heeb ..... B65D 83/48 239/337
4,413,755 A * 11/1983 Brunet ..... B65D 83/54 222/402.2
4,466,838 A * 8/1984 Heeb ..... C09K 3/30 106/311
4,702,400 A * 10/1987 Corbett ..... G01F 11/32 222/402.2
4,953,759 A * 9/1990 Schmidt ..... B65D 83/54 222/402.2
5,037,012 A * 8/1991 Langford ..... B05B 15/20 222/402.2
5,169,038 A * 12/1992 Di Giovanni ..... B65D 83/54 222/402.2
5,593,069 A * 1/1997 Jinks ..... B65D 83/54 222/246
5,632,421 A * 5/1997 Colombo ..... B65D 83/38 222/402.2
5,904,274 A * 5/1999 Warby ..... B65D 83/54 222/402.2
6,112,950 A * 9/2000 Di Giovanni ..... F16K 25/005 222/402.1
6,129,247 A * 10/2000 Thomas ..... B65D 83/48 222/402.1
6,170,717 B1 * 1/2001 Di Giovanni ..... C22B 5/10 222/402.2
6,196,276 B1 * 3/2001 De Laforcade ..... B65D 83/425 141/20
6,318,603 B1 * 11/2001 Burt ..... B65D 83/54 222/402.1
6,345,740 B1 * 2/2002 Riebe ..... B65D 83/38 222/402.1
6,596,260 B1 * 7/2003 Brugger ..... A61K 9/008 128/200.24
6,644,306 B1 * 11/2003 Riebe ..... A61M 15/009 128/200.23
6,843,392 B1 * 1/2005 Walker ..... A61P 11/00 222/402.1
6,926,178 B1 * 8/2005 Anderson ..... A61P 43/00 222/402.2
6,983,743 B2 * 1/2006 Hoelz ..... A61M 15/009 128/200.23
7,278,556 B2 * 10/2007 Goujon ..... B65D 83/54 222/402.1
7,793,807 B2 * 9/2010 Goujon ..... B65D 83/54 222/402.2
8,286,941 B2 * 10/2012 Fontela ..... B65D 83/38 251/354
8,408,431 B2 * 4/2013 Fontela ..... B65D 83/54 222/402.2
8,434,648 B2 * 5/2013 Marie ..... B65D 83/36 222/402.1
10,029,844 B2 * 7/2018 Seki ..... B65D 83/38
10,364,898 B2 * 7/2019 Petit ..... B65D 83/54
10,421,599 B2 * 9/2019 Jacuk ..... C08L 23/16
2003/0180228 A1 * 9/2003 Cripps ..... B65D 81/266 424/46
2004/0035417 A1 * 2/2004 Ottolangui ..... B65D 83/54 128/202.17
2004/0129737 A1 * 7/2004 Anderson ..... B65D 83/54 222/402.24
2006/0249543 A1 * 11/2006 Pardonge ..... B65D 83/38 222/402.1
2007/0145081 A1 * 6/2007 Goujon ..... B65D 83/54 222/402.2
2007/0272767 A1 11/2007 Niggemann
2009/0008584 A1 * 1/2009 Fontela ..... B65D 83/38 251/118
2010/0051651 A1 * 3/2010 Allsop ..... B65D 83/425 222/402.2
2010/0300437 A1 * 12/2010 Sivigny ..... A61M 15/0065 128/203.12
2012/0160878 A1 * 6/2012 Burel ..... B65D 83/54 222/402.2
2014/0231466 A1 * 8/2014 Du Boisbaudry .. B05B 11/0005 222/402.1
2015/0023883 A1 1/2015 Menon et al.
2018/0134481 A1 * 5/2018 Bodet ..... B65D 83/38

OTHER PUBLICATIONS

International Preliminary Report on Patentability with translation of the Written Opinion dated Nov. 14, 2019, issued by the International Bureau in corresponding application PCT/FR2018/051119.

* cited by examiner

METERING VALVE AND FLUID PRODUCT DISPENSING DEVICE COMPRISING SUCH A VALVE

CROSS REFERENCE TO RELATED APPLICATIONS

This application is a National Stage of International Application No. PCT/FR2018/051119, filed on May 4, 2018, which claims priority from French Patent Application No. 1754009, filed on May 5, 2019.

The present invention relates to a metering valve and to a fluid dispenser device including such a valve.

"Metering valves" in which an accurate dose of fluid is dispensed each time the valve is actuated are well known in the prior art, and they are generally assembled on a reservoir containing the fluid and a propellant gas that is used to expel the dose.

Two main types of metering valve are known.

Retention valves include a valve member that, in the rest position, closes the metering chamber in part. More precisely, the outside of the valve member co-operates in leaktight manner with the chamber gasket of the metering chamber such that, in the rest position, the metering chamber is connected to the reservoir only via the internal channel of the valve member.

Metering chambers of "primeless" valves fill only just before actuation proper.

In both configurations, the reservoir is generally filled with the fluid that is to be dispensed after the metering valve has been assembled on the reservoir, and it is filled through said metering valve.

An important parameter for a metering valve is the content of fine particles dispensed on each actuation. Specifically, such fine particles are particularly effective from a therapeutic point of view.

Another important parameter is the time taken to fill the reservoir through the metering valve, which filling time should not be too long, so as not to slow down the manufacturing process.

Documents WO 2014/199182, US 2007 272767, and US 2015 023883 describe prior-art devices.

An object of the present invention is to provide a metering valve that does not have the above-mentioned drawbacks.

An object of the present invention is thus to provide a metering valve that optimizes the content of fine particles dispensed on each actuation, while guaranteeing a filling speed through said valve that is acceptable.

A particular object of the present invention is to provide a metering valve that is simple and inexpensive to manufacture and to assemble, and that is reliable in operation.

The present invention thus provides a metering valve for dispensing fluid, the metering valve comprising a valve body containing a metering chamber, a valve member slidable axially in said valve body between a rest position and a dispensing position so as to dispense the contents of said metering chamber selectively, said valve member being urged towards its rest position by a spring that co-operates firstly with said valve body and secondly with said valve member, said valve member including a central axial channel that is provided with an axial outlet orifice and with a radial inlet channel that is arranged in said metering chamber when said valve member is in its dispensing position, said radial inlet channel including, in the fluid dispensing direction, an inlet opening and an outlet opening that opens out into said central axial channel, the diameter of said radial inlet channel lying in the range 0.30 millimeters (mm) to 0.40 mm, and is advantageously about 0.35 mm, the diameter of said outlet opening being equal to the diameter of said radial inlet channel, and the diameter of said inlet opening being greater than the diameter of said radial inlet channel.

Advantageously, said radial inlet channel is cylindrical over a major portion of its length, starting from said outlet opening.

Advantageously, the diameter of said inlet opening lies in the range 0.6 mm to 0.8 mm, and is advantageously about 0.7 mm.

Advantageously, the radial depth of said inlet opening is about 0.2 mm.

The present invention also provides a fluid dispenser device comprising a metering valve as defined above, fastened on a reservoir.

These characteristics and advantages and others of the present invention appear more clearly from the following detailed description thereof, given by way of non-limiting examples, and with reference to the accompanying drawings, and in which.

In the following description, the terms "upper", "lower", "top", "bottom", "vertical", and "horizontal" refer to the upright position shown in FIG. 1, and the terms "axial" and "radial" refer to the longitudinal central axis of the valve shown in FIGS. 1 and 2.

Figure 1:
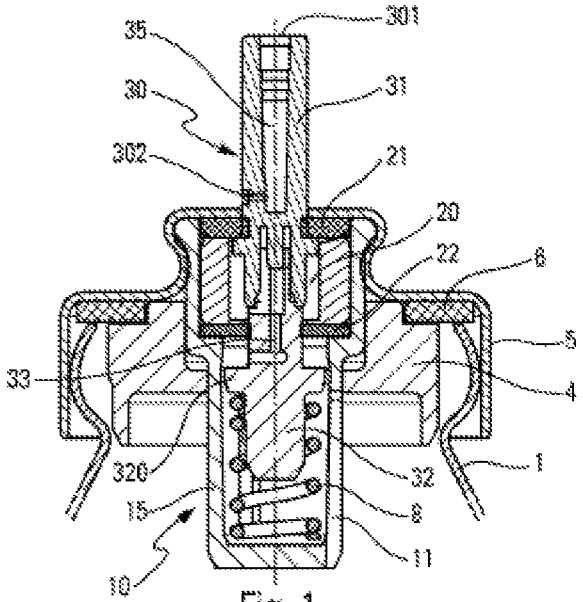
FIG. 1 is a diagrammatic section view of a dispenser valve in the rest position of the valve member, in the upright storage position of the valve.
Figure 2:
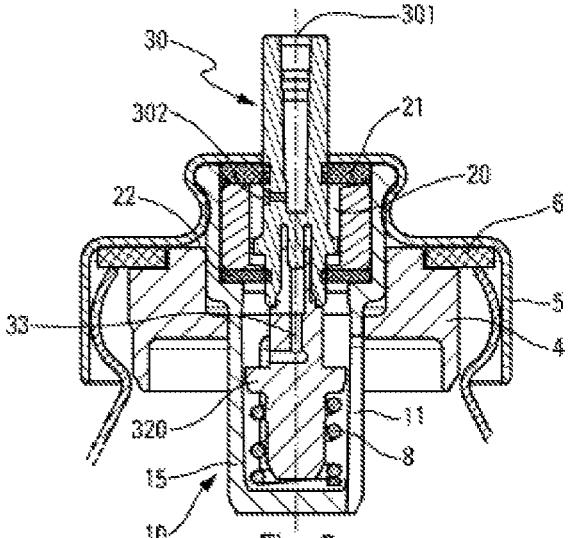
FIG. 2 is a view similar to the view in FIG. 1, in the actuated position of the valve member.

The metering valve shown in FIG. 1 includes a valve body 10 that extends along a longitudinal central axis. Inside said valve body 10, a valve member 30 slides between a rest position, which is the position shown in the FIG. 1, and a dispensing position as shown in FIG. 2, in which the valve member 30 has been pushed into the valve body 10.

The valve is for assembling on a reservoir 1 (only the neck of which is shown in diagrammatic manner in FIG. 1) preferably by means of a fastener element 5 that may be a crimpable, screw-fastenable, or snap-fastenable capsule, and a neck gasket 6 is advantageously interposed between the fastener element and the reservoir. Optionally, a ring 4 may be assembled around the valve body 10, in particular so as to decrease the dead volume in the upsidedown position, and so as to limit contact between the fluid and the neck gasket 6. The ring 4 may be of any shape, and the example in FIG. 1 is not limiting. In general, the reservoir 1 contains the fluid and the propellant gas, in particular a formulation made up of one or more active principles in suspension and/or in solution in a liquefied propellant gas, and possibly excipients.

The valve member 30 is urged towards its rest position by a spring 8 that is arranged in the valve body 10 and that co-operates firstly with the valve body 10 and secondly with the valve member 30, preferably with a radial collar 320 of the valve member 30. A metering chamber 20 is defined inside the valve body 10, said valve member 30 sliding inside said metering chamber 20 so as to enable its contents to be dispensed when the valve is actuated.

In conventional manner, the metering chamber 20 is preferably defined between two annular gaskets, namely a valve-member gasket 21, and a chamber gasket 22.

The valve body 10 includes a cylindrical portion 15 in which the spring 8 is arranged, and in which the collar 320 slides between its rest and dispensing positions. In the position in FIG. 1, the cylindrical portion 15 is the bottom portion of the valve body. The cylindrical portion 15 includes one or more longitudinal openings 11, such as slots, that extend sideways in said cylindrical portion 15 of the valve body, over a fraction of the axial height of the valve body in the direction of the longitudinal central axis. The openings 11 make it possible to fill the metering chamber 20 after each actuation in the upsidedown working position (with the valve arranged below the reservoir) when the valve member 30 returns from its dispensing position to its rest position.

FIG. 1 shows the valve in the upright storage position, i.e. the position in which the metering chamber 20 is arranged above the reservoir.

The valve member 30 includes a central axial channel 35 that is provided with an axial outlet orifice 301 and with a radial inlet channel 302 that is arranged in the metering chamber 20 when the valve member 30 is in its dispensing position. In the fluid dispensing direction, the radial inlet channel 302 includes an inlet opening 3021 and an outlet opening 3022, the outlet opening opening out into said central axial channel 35.

Surprisingly, it has been found that the dimensions of said radial inlet channel 302 have an impact on the quantity of fine particles dispensed in each dose.

Figure 5:
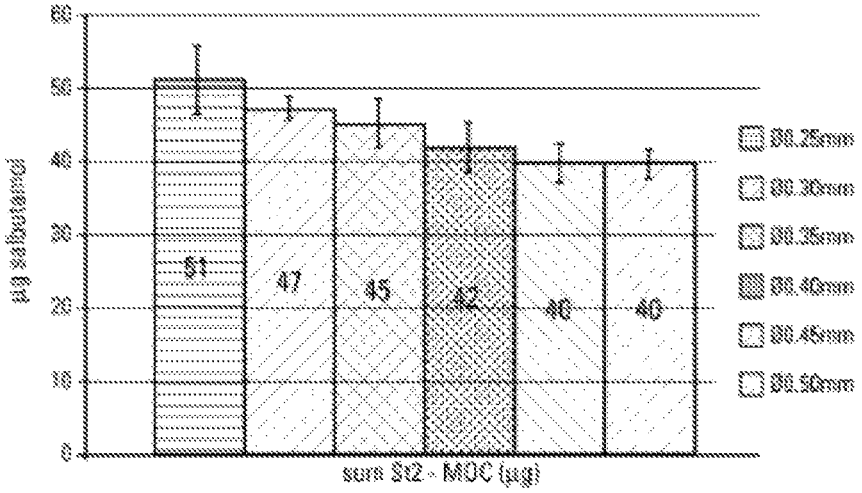
FIG. 5 is a bar chart showing the quantities of fine particles expelled as a function of the diameter of the side hole of the valve member.

The FIG. 5 bar chart shows test results that demonstrate this effect.

Thus, FIG. 5 demonstrates that the smaller the diameter of the radial inlet channel 302, the greater the content of fine particles dispensed through the outlet opening 3022 of the valve member 30. These results may be explained as follows: by decreasing the diameter of the radial inlet channel 302, the time taken for the formulation to pass through said radial inlet channel increases because of the increase in resistance. As a result, the formulation is dispensed at a slower flowrate, which limits the deposit of fine particles in the throat region, consequently enabling a deeper deposit in the bronchi.

FIG. 5 also shows that above 0.40 mm, the change in diameter no longer has any impact on the fine particles.

The test in FIG. 5 consisted in evaluating the Aerodynamic Particle Size Distribution (APSD) of particles coming from a metering valve. The test was performed with a specific piece of equipment known as a pharmaceutical impactor, and more precisely the Next Generation Impactor (NGI) (described in the pharmacopeia under the name apparatus E). The tests were performed at a flowrate of 30 liters per minute (L/min). The bar chart in FIG. 5 shows the sum of fine particles that entered into the impactor. It should be observed that the smaller the diameter of the radial inlet channel 302, the more effective the valve in terms of size of particles expelled during spraying. The values indicated in the bar chart in FIG. 5 are quantities of fine particles, i.e. particles of size that is "small". In the context of the FIG. 5 test, the particles had an aerodynamic diameter of less than 6.4 micrometers (μm). It is particularly advantageous for this value to be as large as possible, since fine particles of appropriate size are particularly effective from a therapeutic point of view.

The tests were performed with a formulation containing a high percentage of ethanol (15 percent by weight (wt %)), an excipient, an active principle (salbutamol sulfate), and HFA 134a as propellant gas. The reservoirs tested were all filled with the same formulation.

Naturally, the smaller the diameter of the radial inlet channel 302, the greater the time taken to fill the reservoir 1 through the valve. However, a filling time that is too long can turn out to be unacceptable.

Figure 6:
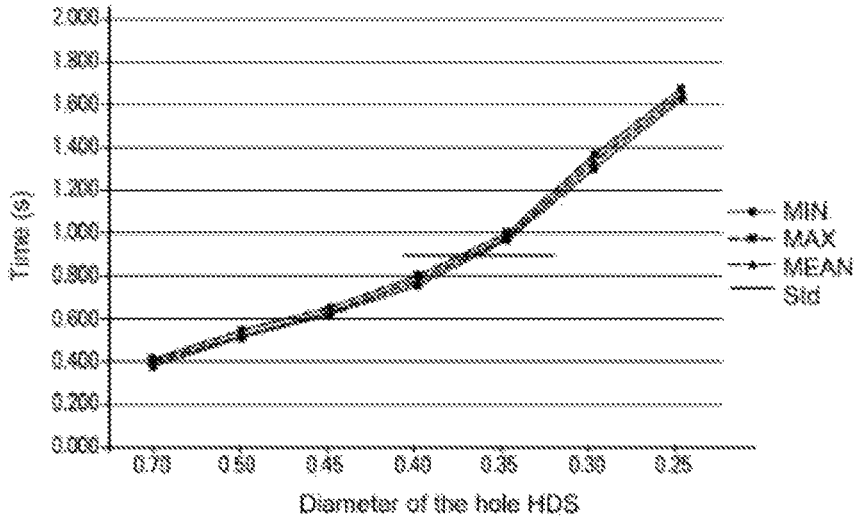
FIG. 6 is a graph showing the times taken to fill the reservoir through the valve as a function of the diameter of the side hole of the valve member.

FIG. 6 is a graph showing filling times as a function of the diameter of the radial inlet channel 302. The time indicated is the filling time only and does not take into account the entire cycle (putting the reservoir into place in the machine, lowering the filling head, etc.). The violet line shows the typical time for a standard valve, and it is desirable not to depart too much from this line.

FIG. 6 shows that below 0.30 mm, the filling time becomes too long.

Consequently, in the invention, the diameter of the radial inlet channel 302 lies in the range 0.30 mm to 0.40 mm, and is advantageously about 0.35 mm. This makes it possible to optimize the amount of fine particles dispensed, without slowing down unacceptably the time taken to fill the reservoir. The therapeutic effectiveness of the fluid dispensed is thus improved.

In the advantageous embodiment shown in the figures, the radial inlet channel 302 is cylindrical over a major portion of its length, starting from said outlet opening 3022 to said inlet opening 3021.

Figure 3:
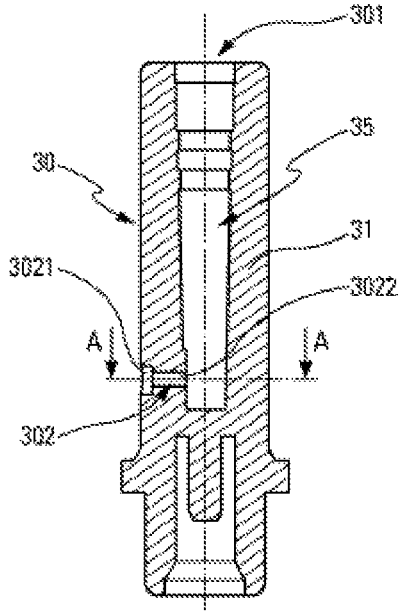
FIG. 3 is a vertical section view of a detail of the valve member in FIGS. 1 and 2.
Figure 4:
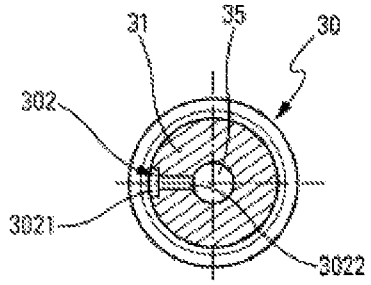
FIG. 4 is a horizontal section view of a detail on section plane A-A in FIG. 3.

The diameter of said outlet opening 3022 is equal to the diameter of said radial inlet channel 302, while the diameter of said inlet opening 3021 is greater than the diameter of said radial inlet channel 302, in particular lying in the range 0.6 mm to 0.8 mm, and is advantageously about 0.7 mm, while the radial depth of said inlet opening 3021 is advantageously about 0.2 mm. This can be seen in particular in FIGS. 3 and 4. This embodiment is advantageous during molding in order to reduce the length of the fragile small-diameter pin for making the radial inlet channel 302. Furthermore, this embodiment makes it possible to avoid having such a fragile pin that is tangential to the outer circular edge of the valve member. This further strengthens the molding means, and thus improves the manufacturing reliability of the valve member.

In known manner, the valve member 30 may be made of two portions, namely an upper portion 31 (also known as a valve-member top) and a lower portion 32 (also known as a valve-member bottom). The upper portion 31 includes said central axial channel 35, said axial outlet orifice 301, and said radial inlet channel 302. In this embodiment, the lower portion 32 is assembled inside the upper portion 31.

An internal channel 33 is provided in the valve member 30, in particular in the bottom portion 32, that makes it possible to connect the metering chamber 20 to the reservoir 1, so as to fill said metering chamber 20 after each actuation of the valve when the valve member 30 returns to its rest position under the effect of the spring 8. Filling is performed when the device is still in its upsidedown working position, with the valve arranged below the reservoir 1.

In the embodiment in FIG. 1, when the valve member 30 is in its rest position, the metering chamber 20, outside the valve member 30, is substantially isolated from the reservoir 1 by cooperation between the lower portion 32 of the valve member 30 and the chamber gasket 22. In the rest position, the metering chamber 20 thus remains connected to the reservoir 1 merely via said internal channel 33. The valve shown in FIGS. 1 and 2 is thus a retention valve. However, the invention is also applicable to other types of valve, in particular valves of the ACT type.

Although the present invention is described above with reference to a particular embodiment thereof, naturally it is not limited by the embodiment shown. On the contrary, any useful modification could be applied thereto by a person skilled in the art, without going beyond the ambit of the present invention, as defined by the accompanying claims.

The invention claimed is:

1. A metering valve for dispensing fluid, the metering valve comprising a valve body containing a metering chamber, a valve member slidable axially in said valve body between a rest position and a dispensing position so as to dispense fluid of said metering chamber selectively, said valve member being urged towards the rest position by a spring that co-operates firstly with said valve body and secondly with said valve member, said valve member including a central axial channel that is provided with an axial outlet orifice and with a radial inlet channel that is arranged in said metering chamber when said valve member is in the dispensing position, said radial inlet channel extends, in a fluid dispensing direction, from an inlet opening to an outlet opening that opens out into said central axial channel, wherein a diameter of said radial inlet channel lies in the range 0.30 mm to 0.40 mm, a diameter of said outlet opening being equal to the diameter of said radial inlet channel, and a diameter of said inlet opening being greater than the diameter of said radial inlet channel.

2. A valve according to claim 1, wherein said radial inlet channel is cylindrical over a major portion of its length, starting from said outlet opening.

3. The valve according to claim 1, wherein the diameter of said inlet opening lies in the range 0.6 mm to 0.8 mm.

4. The valve according to claim 3, wherein the diameter of said inlet opening is about 0.7 mm.

5. The valve according to claim 1, wherein a radial depth of said inlet opening is about 0.2 mm.

6. The valve according to claim 1, wherein, the diameter of said radial inlet channel is about 0.35 mm.

7. A fluid dispenser device, comprising a metering valve according to claim 1, fastened on a reservoir.

* * * * *